US008540338B2

(12) United States Patent
Loyd et al.

(10) Patent No.: US 8,540,338 B2
(45) **Date of Patent: *Sep. 24, 2013**

(54) PRINTHEAD MAINTENANCE STATION INCLUDING STATION BACKFLUSH

(75) Inventors: John C. Loyd, Beavercreek, OH (US); Gregory J. Sexton, Beavercreek, OH (US)

(73) Assignee: Eastman Kodak Company, Rochester, NY (US)

( * ) Notice: Subject to any disclaimer, the term of this patent is extended or adjusted under 35 U.S.C. 154(b) by 204 days.

This patent is subject to a terminal disclaimer.

(21) Appl. No.: 13/074,388

(22) Filed: Mar. 29, 2011

(65) Prior Publication Data

US 2012/0249675 A1 Oct. 4, 2012

(51) Int. Cl.
*B41J 2/165* (2006.01)

(52) U.S. Cl.
USPC ..... 347/29

(58) Field of Classification Search
USPC ..... 347/29
See application file for complete search history.

(56) References Cited

U.S. PATENT DOCUMENTS 6,199,976 B1 * 3/2001 Sasada ..... 347/85
2010/0053258 A1 * 3/2010 Seino et al. ..... 347/30

* cited by examiner

*Primary Examiner* — Matthew Luu
*Assistant Examiner* — Justin Seo
(74) *Attorney, Agent, or Firm* — William R. Zimmerli

(57) ABSTRACT

A maintenance station apparatus for a printhead including a nozzle face with the nozzle face including a nozzle array for jetting a liquid is provided. The maintenance station includes a capping unit including a drain and a waste liquid tank that receives a waste liquid from the capping unit. A valve is in fluid communication with the capping unit through a first fluid passage and in fluid communication with the waste liquid tank through a second fluid passage. The valve includes a first state that permits the waste liquid to flow from the capping unit through the valve to the waste liquid tank and a second state that prevents the waste liquid from flowing from the capping unit through the valve to the waste liquid tank. A cleaning liquid tank is in fluid communication with the valve through a third fluid passage and is configured to provide a cleaning liquid through the valve and into the first fluid passage when the valve is in the second state.

19 Claims, 4 Drawing Sheets

PRINTHEAD MAINTENANCE STATION INCLUDING STATION BACKFLUSH

CROSS REFERENCE TO RELATED APPLICATIONS

Reference is made to commonly-assigned, U.S. patent application Ser. No. 13/074,405, entitled "MAINTAINING PRINTHEAD USING MAINTENANCE STATION WITH BACKFLUSH, filed concurrently herewith.

FIELD OF THE INVENTION

This invention relates generally to the field of digitally controlled printing systems and, in particular to maintenance stations for inkjet printheads.

BACKGROUND OF THE INVENTION

In an inkjet printer, a printhead includes a plurality of jetting modules, each jetting module having a nozzle face in the form of a long narrow rectangular plate with a nozzle array, through which a liquid (e.g., ink) is jetted. When the printhead is not in use, liquid in the nozzle array may dry or attract dust and other contaminants, which can lead to clogging, resulting in decreased print quality, or printhead failure. Typically, when the printhead is not in use, it is moved to a maintenance station that removes the liquid, and other contaminates, so as to minimize the likelihood of clogging or failure.

The maintenance station will generally include the following components, at a minimum: a capping unit, a valve, and a waste tank. The capping unit engages the printhead nozzle face, providing a seal around the nozzle array. The valve is then opened, and a negative pressure from the capping unit or positive pressure from the printhead is applied, causing liquid to flow from the nozzles, which flushes dried ink, dust or other contamination (i.e., waste liquid) from the nozzles. The waste liquid is then transported to the waste tank.

However, the maintenance station components, specifically, orifices at connection points, are subject to fouling from the contamination removed from the printhead. This fouling can be more prevalent when the liquid jetted from the printhead is an ink containing a magnetic pigment, which is used in magnetic ink character recognition (MICR).

As such, there is an ongoing need for a maintenance station, having a reduced risk of becoming contaminated, which effectively removes liquid, dust, and other contaminants from a printhead.

SUMMARY OF THE INVENTION

According to one aspect of the present invention, a maintenance station apparatus for a printhead including a nozzle face with the nozzle face including a nozzle array for jetting a liquid is provided. The maintenance station includes a capping unit including a drain and a waste liquid tank that receives a waste liquid from the capping unit. A valve is in fluid communication with the capping unit through a first fluid passage and in fluid communication with the waste liquid tank through a second fluid passage. The valve includes a first state that permits the waste liquid to flow from the capping unit through the valve to the waste liquid tank and a second state that prevents the waste liquid from flowing from the capping unit through the valve to the waste liquid tank. A cleaning liquid tank is in fluid communication with the valve through a third fluid passage and is configured to provide a cleaning liquid through the valve and into the first fluid passage when the valve is in the second state.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
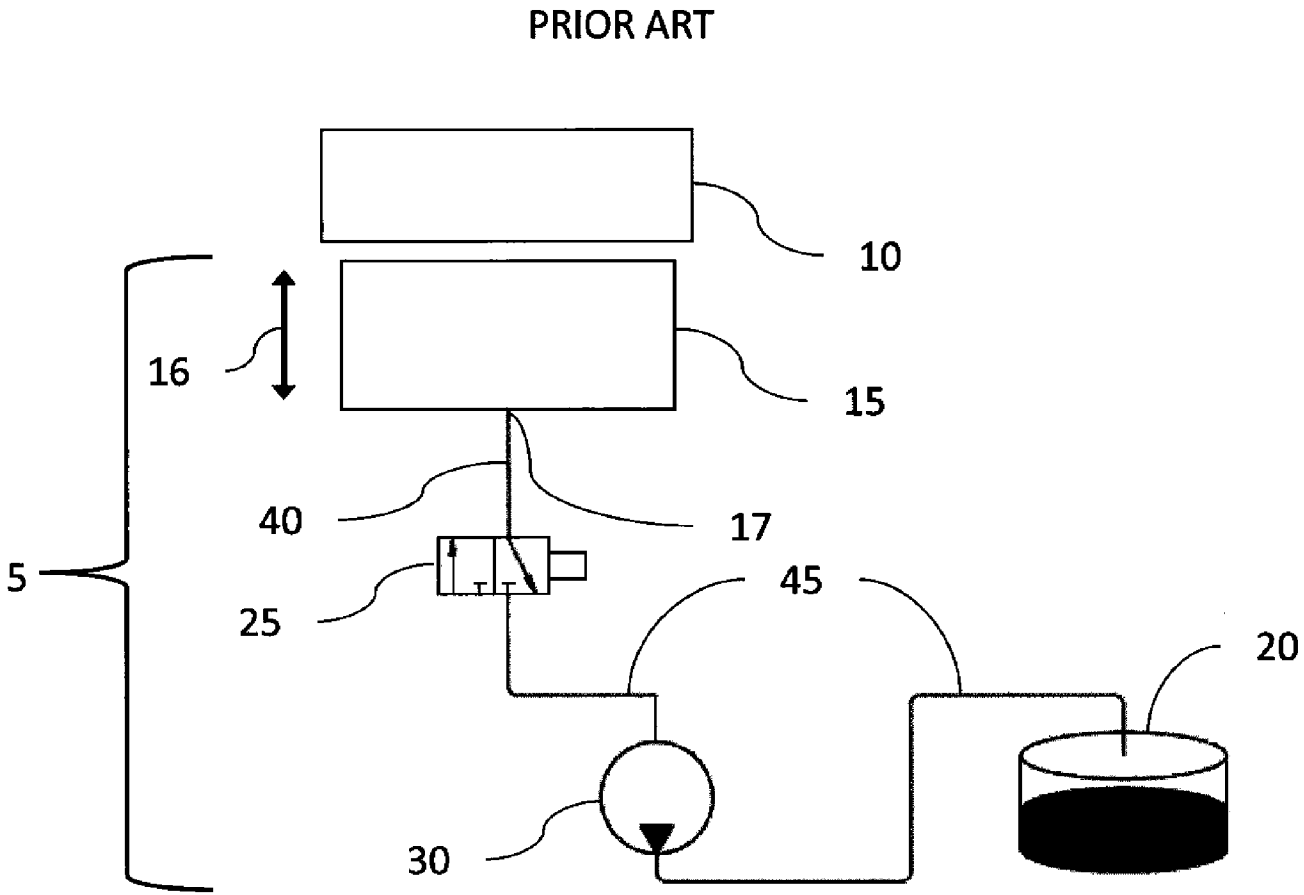
FIG. 1 is a schematic of a prior art maintenance station where a capping unit can engage a printhead to remove liquid and other contaminants.

The present description will be directed in particular to elements forming part of, or cooperating more directly with, apparatus in accordance with the present invention. It is to be understood that elements not specifically shown or described may take various forms well known to those skilled in the art. Throughout the description, common reference numerals are used for common parts. It is to be understood that elements not specifically shown or described may take various forms well known to those skilled in the art.

Referring to FIG. 1, a schematic view of a prior art maintenance station 5 is shown. A printhead 10 is located in a parked position that is vertically above a capping unit 15. The capping unit 15 is movable along an axis perpendicular to the printhead 10, illustrated using arrow 16, such that the capping unit 15 can engage the printhead 10, and form a seal around the nozzle array located on the printhead nozzle face.

The capping unit 15 includes a drain 17 that is in fluid communication with a valve 25 via a first fluid passage 40. A waste liquid tank 20 is in fluid communication with the valve 25 via a second fluid passage 45.

Operationally, valve 25 includes a first state and a second state. When the valve 25 is in the first state, the waste liquid removed from the printhead 10 is permitted to flow through the valve 25 to the waste liquid tank. When the valve 25 is in the second state, no waste fluid is permitted to flow through the valve 25. As shown in FIG. 1, valve 25 is in the second state. The valve 25 can be any valve providing the function describe above, for example, an electro-mechanically operated valve or an air-operated valve. An example of an electromechanically operated valve is a solenoid valve.

In the arrangement shown, there is a purge pump 30 that creates a differential pressure to remove the waste liquid from the capping unit 15 and into the waste liquid tank 20. While the purge pump 30 is shown to be between the valve 25 and the waste liquid tank 20, other example embodiments position purge pump 30 after the waste liquid tank 30. The purge pump is used to create a negative pressure within the waste liquid tank 30, thereby drawing the waste liquid into the waste liquid tank 30.

Alternatively, the jetting modules of printhead 10 can be pressurized to force any liquid, dust, or other contamination from the printhead 10, into the capping unit 15. Then, either gravity or pressurization of the jetting modules can also be used to remove the waste liquid from the capping unit 15 to the waste liquid tank 20.

The flow of the waste liquid in FIG. 1 is only in one direction. As such, the materials contained within the waste fluid, such as pigments or highly viscous humectants, can collect or rise in concentration within the valve 25. This can cause fouling of the valve 25, causing the valve to seize, to have restricted flow, or to otherwise fail to function properly. Additionally, when the valve 25 used within the maintenance station 5 is actuated using a solenoid or other electromechanical actuator, the current through the solenoid or electromagnetic actuator can heat the valve accelerating the drying of ink in the valve. Additionally, the motive force used to energize or actuate this type of valve to change the valve 25 from the first state to the second state, and vice versa, involves an electromagnetic field. This electromagnetic field, when applied, can affect the magnetic pigment contained in MICR inks which can increase the risk of fouling the valve.

Figure 2:
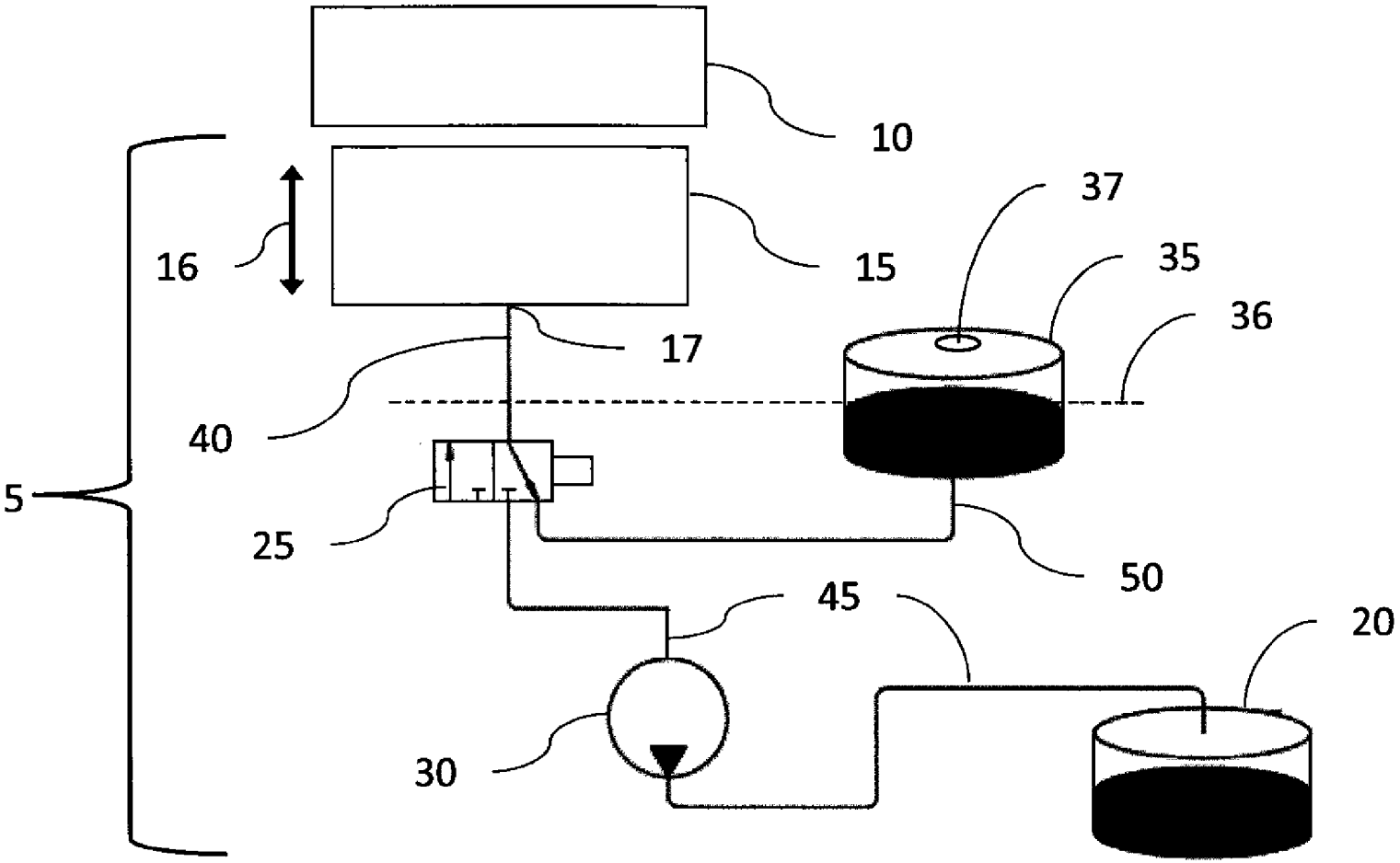
FIG. 2 is a schematic view of an embodiment of the maintenance station that includes a cleaning liquid passage used to provide a cleaning liquid to the components within the maintenance station.

Referring to FIG. 2, an example embodiment of the present invention is shown. Maintenance station 5 includes a third fluid passage 50. Valve 25 is in fluid communication with a cleaning liquid tank 35 containing a cleaning liquid. During a cleaning operation, the capping unit 15 engages the printhead 10 and the waste liquid is removed, exiting the capping unit via the drain 17, through the first fluid passage 40. The valve 25 is in a first state, permitting the waste liquid to flow into the second fluid passage 45 and to the waste liquid tank 20 via the pressure differential created by the purge pump 30.

Cleaning liquid tank 35 is positioned such that the cleaning liquid level 36 is vertically higher than the valve 25, but vertically lower than the capping unit 15, in either an engaged or non-engaged position with printhead 10. This positioning, along with a vent 37 to atmosphere in the cleaning liquid tank 35, allows the cleaning fluid to flow from the cleaning liquid tank 35 through the third fluid passage 50 through the valve 25 and into the first fluid passage 40 when the valve 25 is in the second state but not to overflow the capping unit 15. As the cleaning liquid flows through the valve 25, materials contained within the waste liquid are either displaced or diluted, helping to ensure that the valve 25 is functioning properly. After the waste liquid is displaced from or diluted in the valve 25 and the valve 25 may be moved back to the first state, the now contaminated cleaning liquid within the first fluid passage 40 is deposited into the waste liquid tank 30 along with the waste liquid collected from the printhead 10.

The cleaning operation can then be repeated, by moving the valve 25 to the second state, allowing the cleaning liquid to again flow through the valve 25 from the cleaning liquid tank 25. The capping unit can then be stored in this condition (i.e., stored "wet"), or the valve 25 can be moved back to the first state and the cleaning liquid drained to the waste tank 20 (i.e., stored "dry").

In general, the higher the viscosity or the higher the solids content of the liquid being jetted, the more likely the maintenance stations 5 of the prior art will foul. Inks containing pigment have a higher risk of fouling the valves of the prior art maintenance stations than to dye based inks. MICR inks, which contain magnetic pigments, are even more likely to cause fouling. While the invented maintenance station is useful for a wide range of inks and other jetting liquids, it is of particular value when used with jetting liquids containing pigments or other fine particles in suspension and even more valuable when MICR inks or other jetting liquids containing magnetic particles in suspension are used.

For pigment based jetting liquids, it is preferred that the cleaning liquid contain a redispersant that is effective to redisperse the pigment contained within the jetted liquid. For example, the FF5124 MICR cleaning fluid, produced by Eastman Kodak Company, is an effective cleaning liquid containing the redispersant for MICR inks. For non-pigment based jetting liquids, the cleaning liquid preferably contains solvents to redissolve the various components found in dried or partially dried ink or other jetting liquid residues. Typically the cleaning fluid does not contain any pigments or other colorants.

In another example embodiment, a metering pump is located within third fluid passage 50 or the cleaning liquid tank 35 and used to control the flow of the cleaning liquid. The metering pump forces a defined amount of the cleaning fluid through the valve 25 into the first fluid passage 40, when the valve 25 is in the second state, such that the cleaning liquid does not overflow the capping unit 15. In this embodiment, the cleaning liquid level 36 does not necessarily need to be vertically higher than the valve 25. A peristaltic pump works effectively as the metering pump, although piston, gear or other types of positive displacement pumps are also effective.

Figure 3:
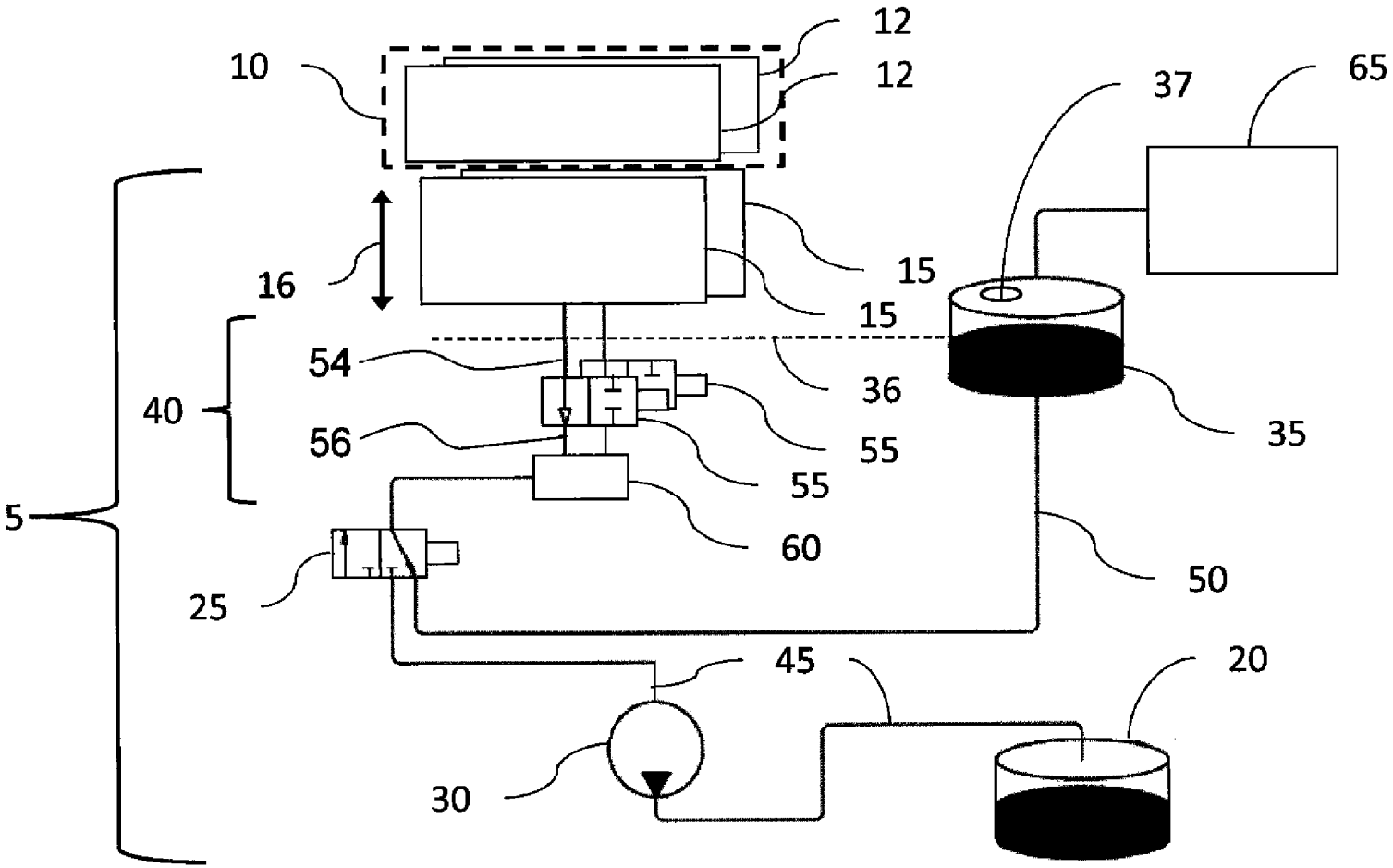
FIG. 3 is a schematic view of an embodiment the maintenance station where the printhead contains multiple jetting modules with a corresponding number of capping units, and a cleaning liquid passage and a liquid level control system.

Referring to FIG. 3, another example embodiment of the present invention is shown. Maintenance station 5 is operatively associated with a printhead 10 that includes multiple jet modules 12, each module 12 having a nozzle face with a nozzle array. There is a plurality of capping units 15 that correspond with each of the jetting modules 12. The capping units 15 are movable, individually or as a group, along an axis perpendicular to the printhead 10, as illustrated by the arrow 16, so that the capping units 15 engage the jetting modules 12 and form a seal around the nozzle array located on the nozzle face.

The capping units 15 are in fluid communication with the valve 25 through the first fluid passage 40. The first fluid passage 40 includes second valves 55 that correspond to each of the capping units 15. An upstream portion 54 of the first fluid passage 40 provides fluid communication between the drain of a capping unit 15 and the corresponding second valve 55. A downstream portion 56 of the first fluid passage 40 provides fluid communication between the second valve 55 and the first valve 25. The second portion can include a manifold 60 to enable multiple second valves 55 to be in fluid communication with the first valve 25. Each capping unit 15 is in fluid communication with the corresponding second valve 55, of which each second valve 55 is in fluid communication with the manifold 60, which collects waste fluid from the capping units 15 and drains the waste fluid through the valve 25 and into the waste tank 20. Each second valve 55 can be operated individually, enabling a specific jetting module 12 to be purged rather than purging all of the jetting modules 12 contain within the printhead 10.

The cleaning liquid tank 35, with a vent 37 to atmosphere, is positioned such that the cleaning liquid level 36 is vertically higher than the second valves 55, but lower than the capping units 15. However, each time the maintenance station 5 is operated, moving the valve 25 from the first state to the second state, the cleaning liquid level 36 will decrease, eventually to a minimum cleaning liquid level, a point at which gravity does not provide the flow necessary to dilute or displace contamination.

As such, the maintenance station 5 includes a liquid level control system 65. The cleaning liquid level 36 is monitored by a sensor within the cleaning liquid tank 35, which signals the cleaning liquid supply to provide additional cleaning fluid when the cleaning liquid level 36 becomes too low. For example, the cleaning liquid tank 35 can include a float switch that signals the cleaning liquid supply to replenish the cleaning liquid tank 35, from an external source, when the cleaning liquid level is too low. Upon receiving the signal, the cleaning liquid supply replenishes the cleaning liquid tank 35 so that the cleaning liquid level 36 is vertically higher than the second valve 55.

Figure 4:
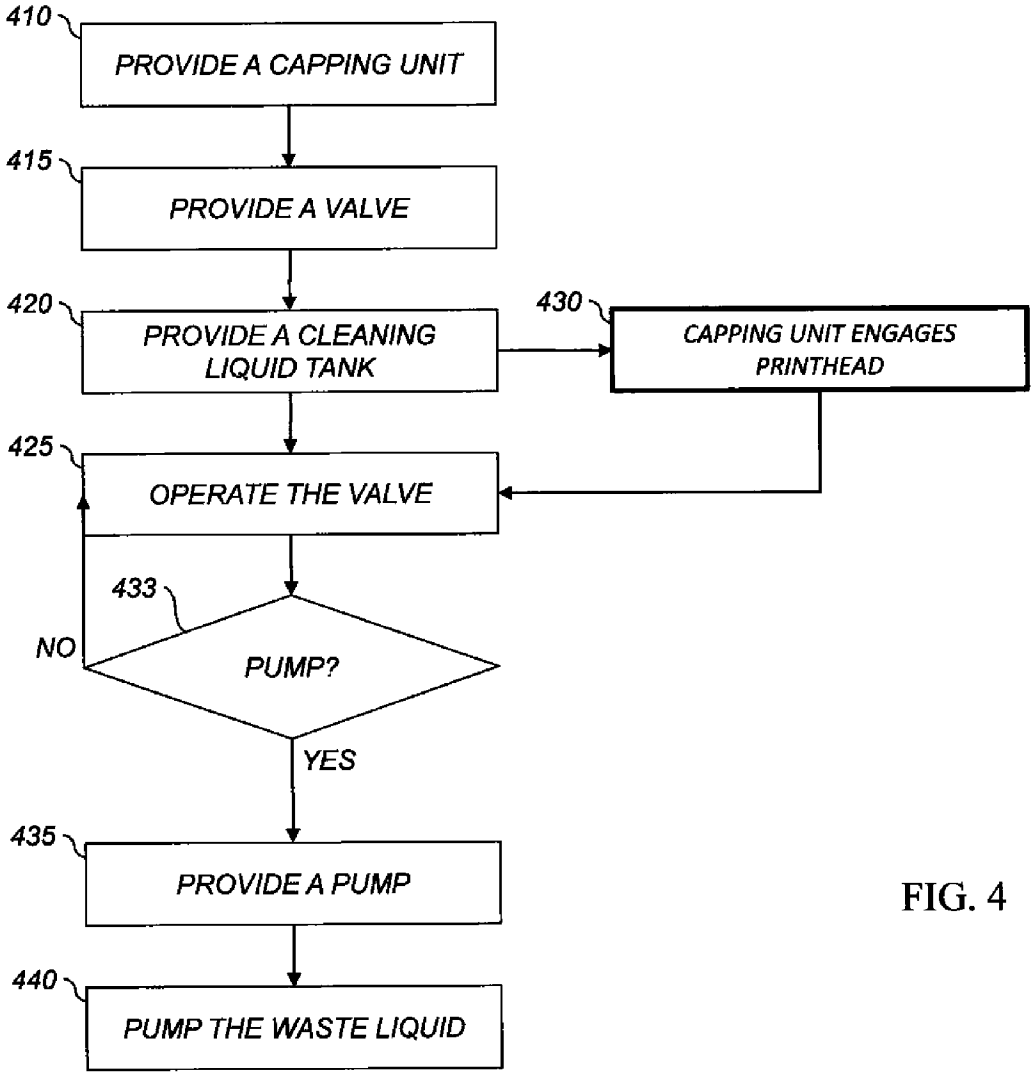
FIG. 4 is a block diagram showing the method of maintaining a printhead according to an embodiment of the invention.

Referring to FIG. 4, printhead maintenance begins with step 410.

In step 410, a capping unit is provided and includes a drain. A waste liquid tank receives a waste liquid from the capping unit. Step 410 is followed by step 415.

In step 415, a valve is in fluid communication with the capping unit through a first fluid passage connected to the drain. The valve is also in fluid communication with the waste liquid tank through a second fluid passage. The valve includes a first state that permits the waste liquid to flow from the capping unit through the valve to the waste liquid tank. The valve includes a second state that prevents the waste liquid from flowing from the capping unit through the valve to the waste liquid tank. Step 415 is followed by step 420.

In step 420, a cleaning liquid tank is in fluid communication with the valve through a third fluid passage. The cleaning liquid tank is configured to provide a cleaning liquid through the valve and into the first fluid passage when the valve is in the second state. Step 420 is followed by step 425 and step 430.

In step 430, the capping unit engages the printhead prior to operating the valve. Step 430 is followed by step 425. In step 425, the valve is operated to cause the valve to move between the first state and the second state. Step 425 is followed by decision step 433.

Decision step 433 decides whether the pump should be operated. If yes, the next step is step 435. If no, the next step is step 425. In step 435, the pump is provided. Step 435 is followed by step 440. In step 440, the pump is used to cause waste liquid to flow from the capping unit through the valve and into the waste liquid tank, when the valve is in the first state.

The invention has been described in detail with particular reference to certain preferred embodiments thereof, but it will be understood that variations and modifications can be effected within the scope of the invention.

PARTS LIST

5 Maintenance Station
10 Printhead
12 Jetting modules
15 Capping unit
16 Arrow
17 Drain
20 Waste liquid tank
25 Valve
27 Second valve
30 Purge pump
35 Cleaning liquid tank
36 Cleaning liquid level
37 Vent
40 First fluid passage
45 Second fluid passage
50 Third fluid passage
54 Upstream portion
55 Second valve
56 Downstream portion
60 Manifold
65 Liquid level control system
410 step
415 step
420 step
425 step
430 step
433 decision step
435 step
440 step

The invention claimed is:

1. A maintenance station apparatus for a printhead including a nozzle face, the nozzle face including a nozzle array for jetting a liquid, the maintenance station comprising:

a capping unit including a drain;

a waste liquid tank that receives a waste liquid from the capping unit;

a valve in fluid communication with the capping unit through a first fluid passage, the valve being in fluid communication with the waste liquid tank through a second fluid passage, the valve including a first state that permits the waste liquid to flow from the capping unit through the valve to the waste liquid tank, the valve including a second state that prevents the waste liquid from flowing from the capping unit through the valve to the waste liquid tank; and a cleaning liquid tank in fluid communication with the valve through a third fluid passage, the cleaning liquid tank being configured to provide a cleaning liquid through the valve and into the first fluid passage when the valve is in the second state.

2. The maintenance station of claim 1, wherein the cleaning liquid tank is positioned relative to the valve and the capping unit such that gravity causes the cleaning liquid to flow from the cleaning liquid tank through the valve and into the first fluid passage when the valve is in the second state.

3. The maintenance station of claim 2, wherein the cleaning liquid tank includes a liquid level control system.

4. The maintenance station of claim 3, the cleaning liquid tank further comprising:

a float switch; and a cleaning liquid supply;

wherein the float switch signals the cleaning liquid supply to replenish the cleaning liquid upon reaching a minimum cleaning liquid level.

5. The maintenance station of claim 1, the valve being a first valve, further comprising:

a second valve located in the first fluid passage, creating an upstream portion of the first fluid passage and a downstream portion of the first fluid passage, the capping unit being in fluid communication with the first valve through the second valve, wherein the cleaning liquid tank is configured to provide the cleaning liquid through the first valve through the downstream portion of the first fluid passage, through the second valve, and into the upstream portion of the first fluid passage.

6. The maintenance station of claim 5, the capping unit being a plurality of capping units and the second valve being a plurality of second valves, corresponding to the plurality of capping units, further comprising:

a manifold located in the downstream portion of the first fluid passage, whereby the plurality of second valves is in fluid communication with the first valve through the manifold.

7. The maintenance station of claim 5, wherein the first valve is a solenoid valve.

8. The maintenance station of claim 5, wherein the second valve is a solenoid valve.

9. The maintenance station of claim 1, wherein the valve is a solenoid valve.

10. The maintenance station of claim 1, wherein the cleaning liquid tank is vented to atmosphere.

11. The maintenance station of claim 1, further comprising:

a pump that causes the waste liquid to flow from the capping unit through the valve and into the waste liquid tank, when the valve is in the first state.

12. The maintenance station of claim 1, wherein the capping unit and the nozzle face are moveable relative to each other.

13. The maintenance station of claim 1, wherein the liquid that is jetted is an ink.

14. The maintenance station of claim 13, wherein the ink comprises a pigment dispersion.

15. The maintenance station of claim 14, wherein the pigment dispersion comprises a magnetic pigment dispersion.

16. The maintenance station of claim 1, wherein the liquid is an ink used for magnetic ink character recognition.

17. The maintenance station of claim 1, wherein the cleaning liquid contains a dispersant.

18. The maintenance station of claim 17, wherein the dispersant is a dispersant for a MICR ink.

19. The maintenance station of claim 18, wherein the liquid jetted is a MICR ink.

* * * * *